United States Patent [19]

Eisinger et al.

[11] 4,240,234

[45] Dec. 23, 1980

[54] ADJUSTABLE BUCKSTAY SYSTEM FOR VAPOR GENERATORS OR THE LIKE

[75] Inventors: Frantisek L. Eisinger, Demarest; Harry H. Pratt, West Orange; Clarence C. Eich, Mountain Lakes, all of N.J.

[73] Assignee: Foster Wheeler Energy Corporation, Livingston, N.J.

[21] Appl. No.: 971,274

[22] Filed: Dec, 20, 1978

[51] Int. Cl.[3] ..... E04B 1/00

[52] U.S. Cl. ..... 52/261; 122/6 A

[58] Field of Search ..... 52/261, 272, 573, 223 R; 110/336; 122/6 A

[56] References Cited

U.S. PATENT DOCUMENTS

| | | | |
|---|---|---|---|
| 1,896,176 | 2/1933 | Kerr . | |
| 2,119,947 | 6/1938 | Blau et al. . | |
| 2,773,487 | 12/1956 | Walter et al. | 122/6 |
| 3,007,455 | 11/1961 | Lieb et al. | 122/6 A |
| 3,078,830 | 2/1963 | Evans | 122/6 |
| 3,203,376 | 8/1965 | Engelhardt | 52/261 X |
| 3,277,870 | 10/1966 | Reale | 122/6 A |
| 3,301,225 | 1/1967 | Boe et al. | 122/510 |
| 3,314,668 | 4/1967 | Rosenak | 266/32 |
| 3,368,535 | 2/1968 | Svendsen et al. | 122/510 |
| 3,861,360 | 1/1975 | Shank, Jr. | 122/6 A |
| 4,059,075 | 11/1977 | Ssinegurski et al. | 122/6 A |

*Primary Examiner*—John E. Murtagh
*Assistant Examiner*—Carl D. Friedman
*Attorney, Agent, or Firm*—Marvin A. Naigur; John E. Wilson; John J. Herguth, Jr.

[57] ABSTRACT

There is disclosed an adjustable buckstay system for use in association with the walls of vapor generators or the like and whereby the magnitude of necessary clearances in various connecting elements of the system may be adjusted to reduce or eliminate vibration in the system.

21 Claims, 13 Drawing Figures

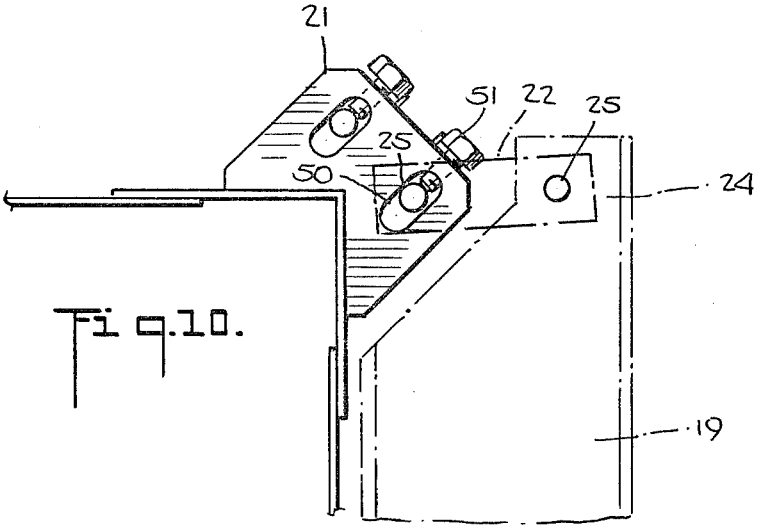
Fig.10.
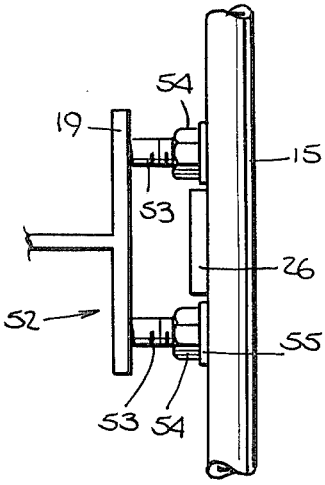
Fig.11.
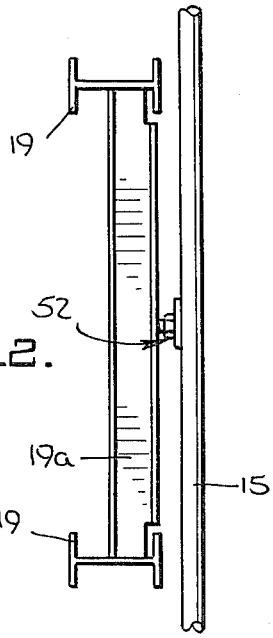
Fig.12.
Fig.13.
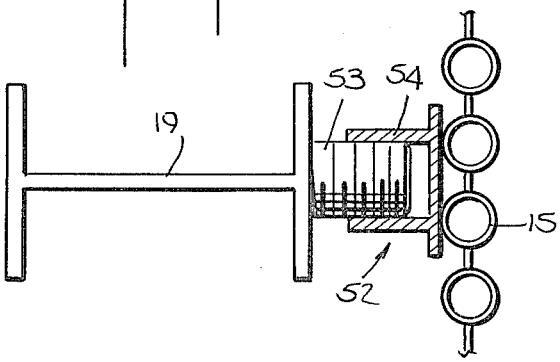

ADJUSTABLE BUCKSTAY SYSTEM FOR VAPOR GENERATORS OR THE LIKE

BACKGROUND OF THE INVENTION

1. Field of the Invention

This invention relates to a buckstay system for vapor generators and the like, and more particularly, to an adjustable buckstay system for controlling vibrations in an operating vapor generator.

2. Description of the Prior Art

Conventional vapor generators comprise a furnace section defined by a plurality of walls formed of vertically disposed, adjacent tubes through which a fluid such as water is passed in order to absorb heat from the surface. These tubes are relatively long and thin walled and may be supported from above to accommodate vertical expansion.

It is also known to provide a system of buckstays to protect the furnace walls against the effects of excessive lateral deflections which may result from relative pressure differentials inside and outside of the furnace walls. Such buckstay systems may comprise beams such as I beams, for example, extending horizontally adjacent the exterior tube surfaces at various elevations of the furnace walls and connected to the walls by suitable lugs, and tension ties arranged parallel to the beams and between the beams and walls. Adjacent beam ends are connected to one another through corner link assemblies which are also connected to the tension ties. The entire system is assembled in a manner to permit relatively free differential thermal expansion between the hot furnace walls and the cooler buckstay beams by means of clearances between the buckstay beams and the furnace walls, between the walls and the tension ties and within the corner link assemblies.

In view of the described organization of the structure, it will be appreciated that the tubes are quite flexible and tend to vibrate under the influence of pressure pulsations propagated through the gas in the furnace section when the unit is fired.

Those skilled in the art will appreciate that the destructive effects of vibration can lead to failure of affected elements such as buckstay system components, for example, and that the aforementioned clearances represent an important factor influencing the vibratory responses within the overall generator system since these clearances render the behavior of the structure nonlinear and highly unpredictable. Thus, the reduction or elimination of vibration is a desired objective in the vapor generator art.

SUMMARY OF THE INVENTION

We have conceived and contribute by the present invention a buckstay system for vapor generators or the like whereby we are able to overcome the foregoing difficulties and disadvantages. Our concept is based upon the realization that the substantial reduction or elimination of vibration may be achieved by applying a load to the structure to change the magnitude and distribution of the clearances, affect the interaction between the furnace walls and the buckstay system and change the vibratory responses within the structure.

In essence, our invention contemplates an adjustable buckstay system for controlling vibrations in a vapor generator of the type described. The buckstay system includes a buckstay beam disposed transversely adjacent each wall of the generator and having end portions which extend beyond the ends of the adjacent walls whereby the end portions of adjacent buckstay beams are juxtaposed at each wall corner defined by the generator walls. Spacer assemblies are provided which have elements connecting the buckstay beams and respective associated walls in spaced relationship, and these include means for permitting relative movement between the beams and the respective associated generator walls due to differential thermal expansion therebetween, and corner assembly means having elements connecting adjacent buckstay beam end portions and including means for permitting relative movement of adjacent end portions due to thermal expansion of the beams. At least one of the means for permitting relative movement between the beams and the generator walls, and between the adjacent beam end portions, include means defining a clearance of predetermined magnitude between connecting elements thereof, and means are provided for adjusting the magnitude of such clearances.

Thus, it will be appreciated that clearance magnitude can be adjusted after the generator is fired up to operating conditions to increase interaction in the buckstay system, and especially increase the load in the tension ties to the point of optimum vibration reduction. The adjustments may be effected at the spacer assemblies between the buckstay beams and the associated generator tube walls, the corner assemblies connecting adjacent buckstay beam end portions, or at any or all such assemblies in the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important therefore that the claims be regarded as including such equivalent constructions as do not depart from the spirit and scope of the invention.

BRIEF DESCRIPTION OF THE DRAWINGS

Specific embodiments of the invention have been chosen for purpose of illustration and description, and are shown in the accompanying drawings forming a part of the specification wherein:

FIG. 1 is a schematic plan view of a buckstay system for a typical vapor generator or the like;

FIGS. 6 to 10 illustrate various forms of adjustment means for use in corner assemblies in accordance with the present invention;

FIGS. 11 and 12 are elevational views illustrating various forms of adjustment means for use in support assemblies connecting buckstay beams with associated generator walls; and FIG. 13 is a detail view of an adjustable spacer assembly.

DESCRIPTION OF THE PREFERRED EMBODIMENTS

Figure 1:
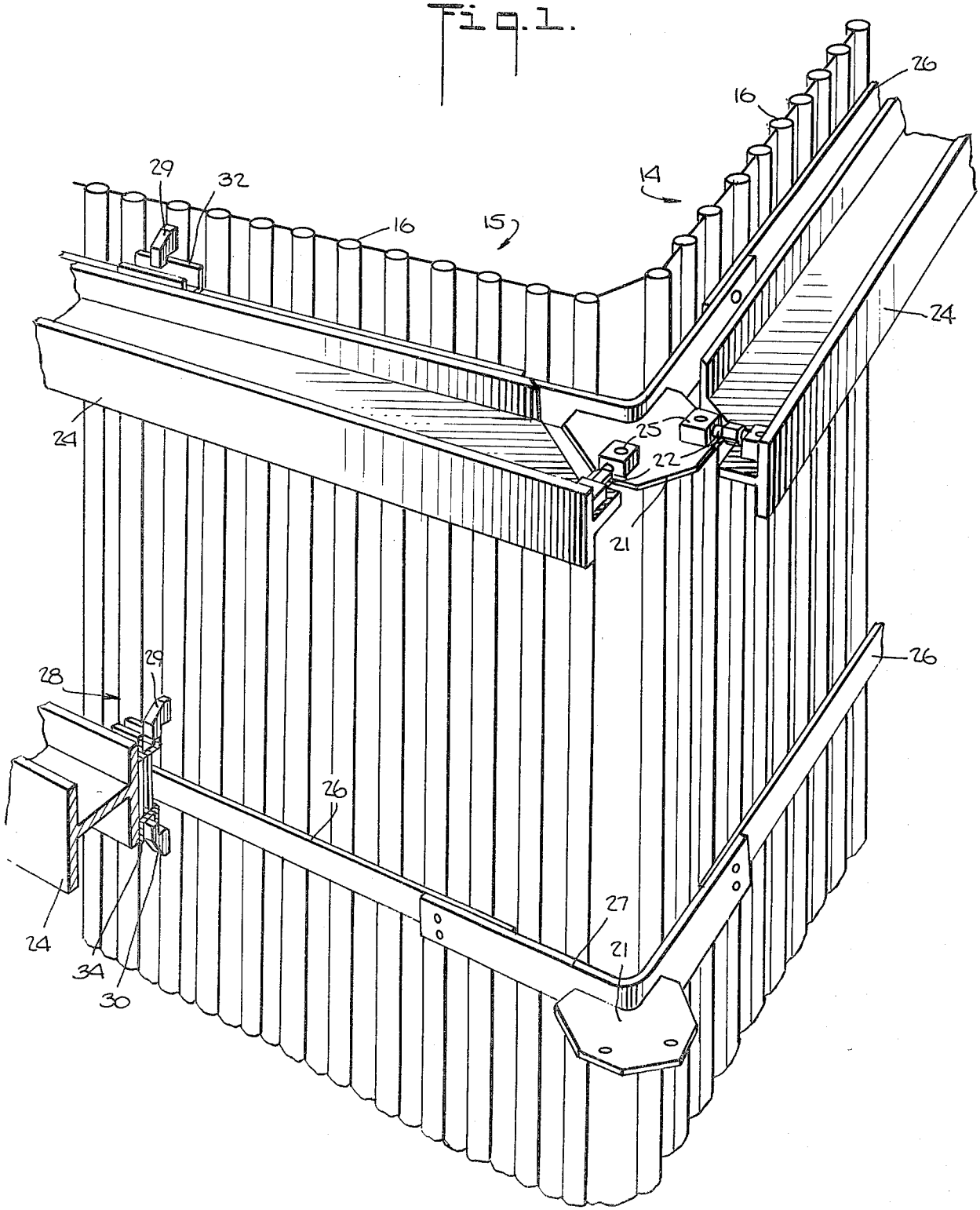
Figure 2:
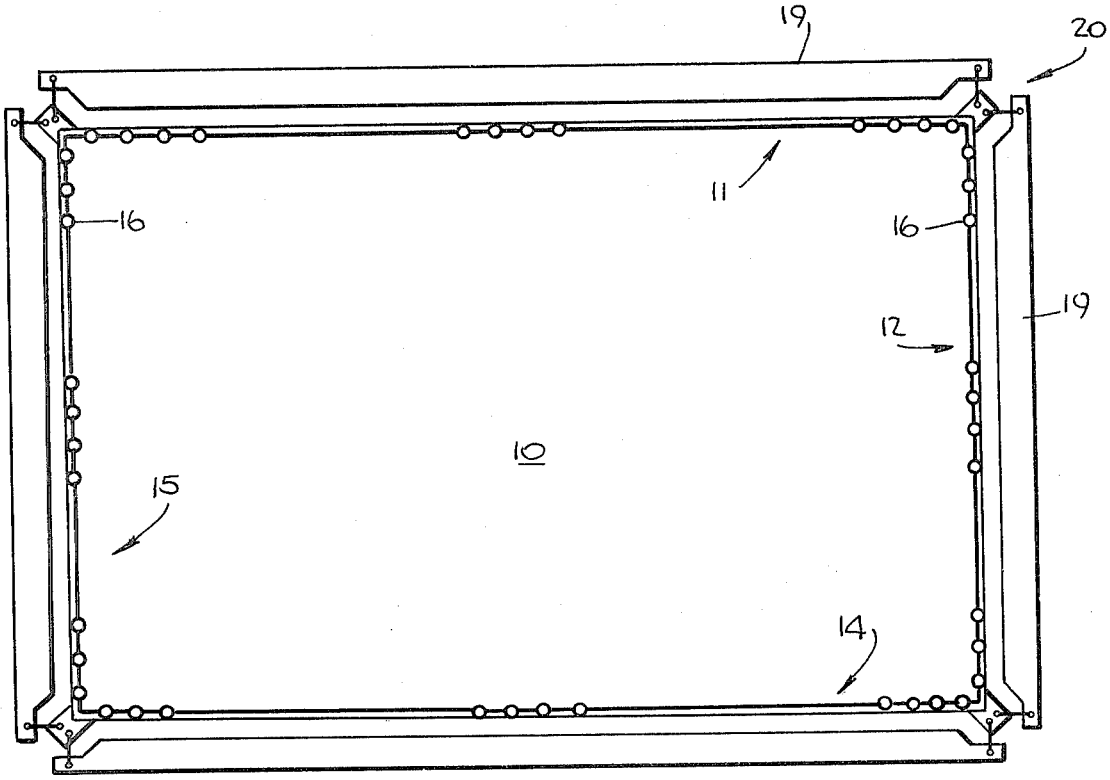
FIG. 2 is a schematic elevational view of such a system.
Figure 3:
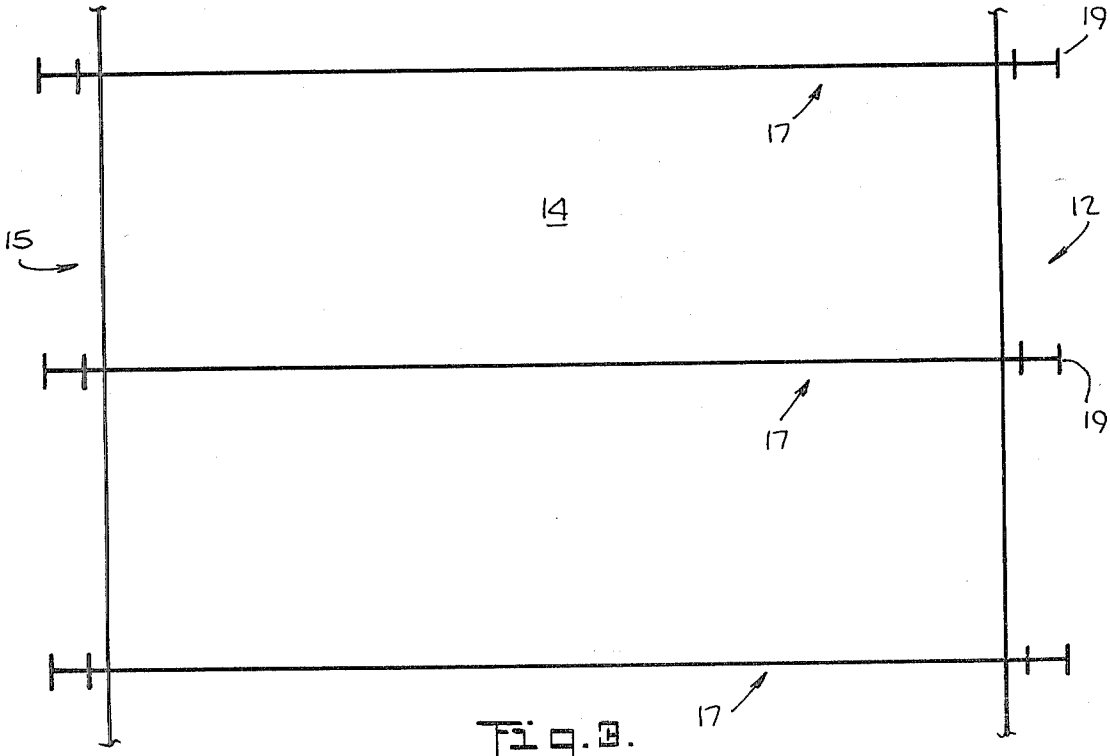
FIG. 3 is a detail plan view illustrating a corner assembly of a system according to the present invention as applied to the walls of a vapor generator.

Referring to FIGS. 1 and 2, it will be seen that a typical vapor generator may comprise a chamber or furnace enclosure 10 defined by walls 11, 12, 14 and 15 formed of adjacent vertical tubes 16 which may be rigidly connected to one another by metal fins. As shown schematically in FIGS. 2 and 3, a system of buckstays 17 is provided at various elevations and around the tubes 16, for purposes already mentioned, and each buckstay system typically includes buckstay beams 19 which may take the form of I-beams and corner assemblies 20 (FIG. 1) through which the ends of adjacent, juxtaposed buckstay beams may be connected to one another.

Figure 4:
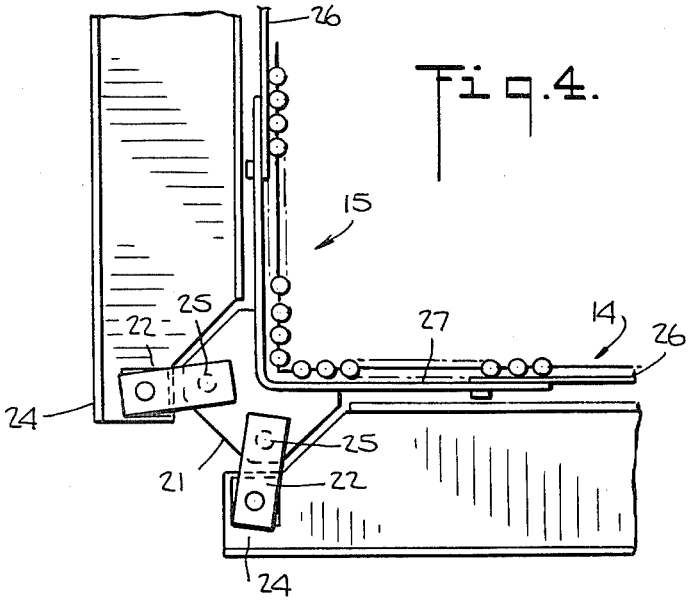
FIG. 4 is an elevational view illustrating a typical buckstay to furnace wall connections.

Referring to FIG. 4 for additional detail, each buckstay corner assembly 20 is shown to include a corner piece 21 at the associated corner formed by adjacent generator walls such as walls 14 and 15, links 22 pivotally connecting the corner piece and adjacent end portions 24 of respective adjacent beams 19 by means of link pins 25. A clearance is provided between the pins 25 and the holes in the corner piece through which they extend, for a purpose later to be described. The corner piece 21 is rigidly secured to tension ties 26 through an angle or corner bar 27. The tension ties 26 extend along the walls parallel to the beams 19 and between the beams and walls with a clearance between the ties and the walls. The tension ties become loaded in tension or compression as the walls bow due, for example, to pressure differentials inside and outside the chamber 10. The beams 19 are supported, at various locations along their length, from the generator walls by support or spacer assemblies 28 which include a pair of lugs 29 and 30 (FIG. 5) connected to the associated wall (wall 15 for example). The lugs 29 and 30 are formed to provide downwardly and upwardly facing recesses 31, respectively, and these recesses each receive a flange of respective channel elements 32 and 34 connected to associated beam 19. The recesses 31 are dimensioned relative to the flanges received thereby as to provide a clearance of predetermined magnitude between the wall 15 and the beam 19 and its integral parts to permit differential thermal expansion of the wall and beam during operation of the generator.

From the description thus far it will be seen that in a typical structure of the class described, parts of the buckstay system, such as the lugs 29 and 30 and beams 19, corner pieces 21 and pins 25, and tension ties 26 and generator walls are formed with clearances so that the system is relatively loosely assembled and parts may expand differentially especially with respect to the generator walls. It will also be understood that, in a typical system, vibration of the walls as well as of the buckstay system may develop as a result of pressure fluctuations in the furnace.

As stated, the present invention is directed to an adjustable buckstay system, that is, a system wherein the mentioned clearances may be adjusted to increase the interaction between components and increase the stiffness of the system in order to reduce or eliminate the mentioned vibrations. The adjustment may be accomplished at the buckstay corners 20, at the support or spacer assemblies 28 or at both. For example, by shortening the distance between pins 25 of the buckstay links 22, clearances between buckstay beams and furnace walls will be reduced and the tension ties will be stressed, that is they will be loaded in tension. The support or spacer assemblies between the buckstay beams 19 and generator walls may also be made adjustable for adjustment alone or to complement adjustments made at the corner assemblies.

Figure 5:
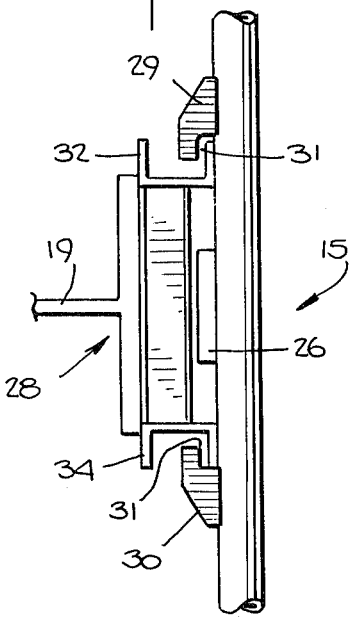
FIG. 5 is a partial perspective view of a vapor generating unit incorporating a novel buckstay system according to the present invention.

As shown in FIG. 5, at each corner of the generator, the beams 19, extending transversely adjacent to walls (14 and 15 for example) formed by tubes 16 of the generator, and defining a corner of the unit, are formed with end portions 24 juxtaposed relative to each other and to corner assemblies 20 which include corner pieces 21 and adjustable links 22 connecting the beam end portions to the corner pieces by means of pins 25. The clearances alluded to earlier may exist between the pins and the holes in the corner pieces through which the pins extend or between the pins and the holes in the links through which the pins also extend. There are also illustrated tension ties 26 secured to corner pieces 21 through corner bars 27 and extending transversely of the generator walls between the beams 19 and tubes 16.

The beams 19 are supported from the generator walls by spacer assemblies 28 which include lugs 29 and 30 respectively providing downwardly and upwardly facing recesses for reception of flanges of channel elements 32 and 34 connected to the beams. These recesses and the flanges received thereby are dimensioned to provide clearances therebetween.

According to the present invention, means are provided to adjust or eliminate the clearances at the corner or spacer assemblies, or at both. In effecting such adjustments at the corner assemblies, the actual or effective length of the links may be adjusted to alter the distance between the link pins at opposite ends of the respective links, thus loading the tension ties 29 in tension when the distances between link pins is shortened.

Figure 6:
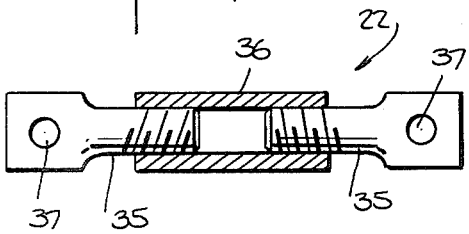

Turning now to FIG. 6, there is shown one construction for adjusting the length of the corner links 22 and thus the distance between the link pins. In this construction, each link consists of a pair of stubs 35 having reduced cylindrical sections threaded, in opposite hand, and a turnbuckle 36 engaging each threaded section so that the length of the link may be effectively adjusted by rotation of the turnbuckle. It will be understood that opposite ends of the link are provided with holes 37 for the link pins 25 (FIG. 3) which pass through the associated corner piece 21 and beam end position with necessary clearance so that the distance between pins 25 passing through holes 37 is adjusted by adjustment of the length of the link 28 as described, due to the existence of the clearances.

Figure 7:
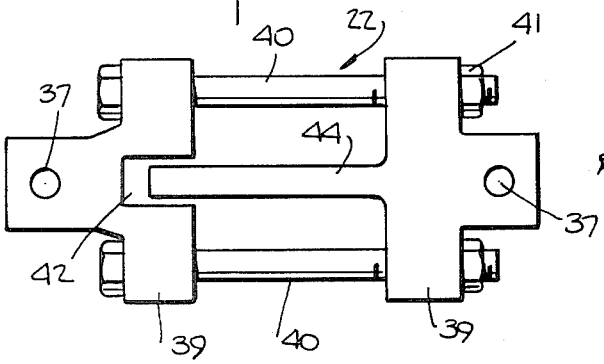

In another form shown in FIG. 7, the link 22 is also formed in two parts such as T-shaped members 39, each having a link pin hole 37 as in the previous case. The cross arms of each member 39 are bored to receive a pair of headed bolts 40 which are threadedly engaged by nuts 41. One of the members 39 has a central recess 42 facing a projecting finger 44 formed in the other member 39 and extending into the recess 42. According to this construction, the effective length of the link 22 may be altered by rotation of the bolts 41 to adjust the distance between members 39.

Figure 8:
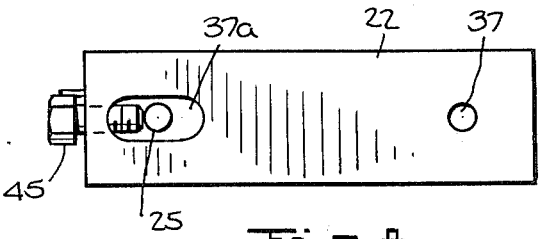

The distance between pins 25 may also be adjusted as in FIG. 8 by forming one of the link pin holes 37 in the link 22 as an oval-shaped slot 37*a*, and providing a stud 45 in threaded engagement with a portion of the link at its end adjacent the slot to extend into the slot and bear against the link pin 25 extending therethrough. Thus, the position of the pin 25 may be adjusted in the slot 37*a* relative to the link 22, and therefore to the pin in the hole 37, by rotating the strut 45.

Figure 9:
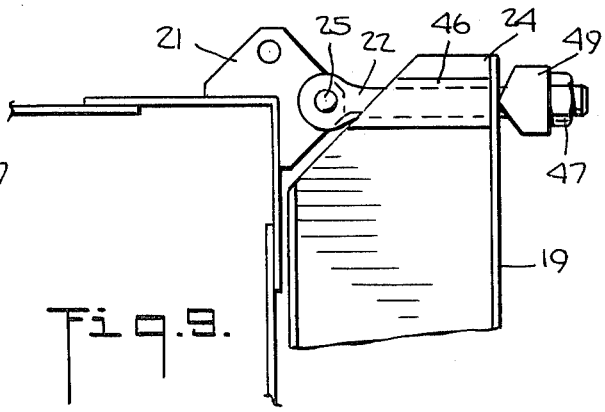

FIG. 9 illustrates another form of link, the effective length of which can readily be adjusted. In this case, the link 22 is cylindrical in form and is connected at one end to the corner piece 21 by link pin 25, and extends through an enlarged cylindrical sleeve 46 on the end portion 24 of beam 19. The other end of the link is threaded to receive a nut 47 which bears against a collar 49 which in turn bears against the flange of the end portion of the beam. The collar 49 may be shaped to taper to a central apex where it meets the flange at each side of the nut to allow for slight rocking movement of the collar on the flange if the link pivots about the pin 25.

The adjustment may also be effected by controlling the positions of one of the link pins relative to the corner piece 21. Thus, as shown in FIG. 10, the openings in the corner piece through which one of the pins of each link passes may be in the form of an oval slot 50 the major axis of which extends approximately parallel to the plane of the bisector of the corner angle formed by the adjacent generator walls. The corner pieces may be constructed to receive, in threaded engagement, headed studs 51 bearing against each pin 25 passing through the slots 50. The pins, and therefore the links, will be adjustable relative to the corner piece by controlling their positions in their respective slots by rotation of the studs 51.

FIGS. 11 and 12 depict spacer assemblies 52 which support the buckstay beams in spaced relationship to the generator walls, and these too are adjustable in accordance with the present invention.

Thus, according to FIG. 11, the beam 19 is spaced from the wall 15, for example, by a pair of spacer studs 53 connected at one end to the beam and threadedly engaging a nut 54 at the other end. Each nut 54 is supported for rotation on a plate 55 disposed flat against the wall 15 and respectively above and below the associated tension tie 26. It will be appreciated that one or both of the nuts 54 may be rotated to adjust the effective length of its corresponding spacer stud 53.

As shown in FIG. 12, the same spacer assembly may be employed, but in this case it is disposed between the generator wall 15, for example, and a vertical buckstay beam 19*a* which extends between and is connected to adjacent transversely disposed beams 19.

FIG. 13 illustrates details for the spacer assembly 52 from which it will be seen that rotation of the nut 54 adjusts the magnitude of the clearance between the distal end of the stud and the plate 55, and therefore the effective length of the stud.

From the foregoing description, it will be seen that we provide an adjustable buckstay system for vapor generators or the like by which we are able to adjust the magnitude of necessary clearances in the system and increase stresses in the system, and especially the tension ties, to increase stiffness and interaction of structural components, thus to reduce or eliminate vibrations and their destructive effects, by manually "detuning" the system when the generator is fired to operating conditions.

We believe that the construction and operation of our novel adjustable buckstay system will now be understood and that the advantages thereof will be fully appreciated by those persons skilled in the art.

We claim:

1. An adjustable buckstay system for controlling vibration in vapor generators and the like which include a plurality of vertically disposed walls defining a chamber for hot gases, said buckstay system comprising:

a buckstay beam disposed transversely adjacent each of said walls and having end portions which extend beyond the ends of the adjacent walls, whereby the end portions of adjacent buckstay beams are juxtaposed at each wall corner defined by adjacent walls of the generator;

spacer assemblies having elements connecting said buckstay beams and respective associated walls in spaced relationship and including means for permitting relative movement between said buckstay beams and respective associated generator walls due to differential thermal expansion between said walls and said beams;

a tension tie disposed transversely adjacent each of said walls between each beam and the associated wall;

corner assembly means having elements connected adjacent buckstay beam end portions to one another and also connecting adjacent tension tie ends to one another and including means for permitting relative movement of adjacent end portions due to thermal expansion of said beams;

at least one of said means for permitting relative movement between said beams and said generator walls, and between said adjacent beam end portions, including means defining a clearance of predetermined magnitude between connecting elements thereof; and adjustment means for adjusting the magnitude of said clearance.

2. A system according to claim 1, wherein said relative movement permitting means comprise stationary means and a member engaged therewith and movable to adjust the magnitude of said clearance.

3. An adjustable buckstay system according to claim 1, wherein said adjustment means comprise a stud connected to said beam and extending toward the associated generator wall and means threadedly engaging said stud to provide a clearance between the distal end of said stud and said wall, said last mentioned means being rotatable to adjust the magnitude of said clearance.

4. The structure according to claim 1, wherein said connecting elements include a corner piece and link means connecting said corner piece and beam end portions and comprising a first member pivotally connected to said corner piece, a second member pivotally connected to a beam end portion, and said adjusting means comprise a turnbuckle connected to said first and second members.

5. The structure according to claim 1, wherein said connecting elements include a corner piece and link means connecting said corner piece and beam end portions and comprising a first member pivotally connected to said corner piece, a second member pivotally connected to a beam end portion, and said adjusting means comprise means of adjustable length connecting said first and second members, and means limiting the extent of adjustment of said first and second members towards each other.

6. The structure according to claim 5, wherein said means of adjustable length comprise threaded bolts extending through said first and second members and nuts threadedly engaging said bolts and adapted to vary the effective length thereof, and wherein said means limiting the extent of adjustment of said first and second members towards each other comprise a recess formed in one of said members and a projection formed on the other of said members and extending into said recess and normally spaced from the base of said recess to define the maximum adjustment of said members towards each other.

7. The structure according to claim 1, wherein said connecting elements include a corner piece and link means connecting said corner piece and beam end portions, said link means being formed with a slot through which said connecting means pass and said adjustment means include means for adjusting the position of said connecting means in said slot.

8. The structure of claim 7, wherein said adjustment means comprise a threaded stud mounted relative to said link means and adapted to abut against said connecting means to adjust the position of same in said slot when said stud is rotated.

9. The structure according to claim 1, wherein said connecting elements include a corner piece and link means connecting said corner piece and beam end portions, said link means extending through said end portion and having a collar formed with a narrow surface bearing against said end portion and said adjustment means is movable on said link means for controlling the position of said collar along the length of said link means.

10. In a vapor generator or the like comprising:

a first pair of oppositely disposed vertical walls, and a second pair of oppositely disposed vertical walls extending between said first pair of walls and joined thereto to define a chamber for hot gases;

a buckstay beam disposed transversely adjacent each of said walls and having end elements which extend beyond the ends of the adjacent wall, whereby end elements of adjacent buckstay beams are juxtaposed at each wall corner defined by adjacent walls of the generator;

means supporting said buckstay beams in spaced relationship to said walls and permitting differential transverse thermal expansion between said walls and said beams; and a tension tie disposed transversely adjacent each of said walls between each beam and the associated wall;

corner assembly means connecting adjacent buckstay beam end elements and adjacent tension tie ends, each assembly means comprising a corner element, and means supporting said corner element relatively to a wall corner, link means extending between said corner element and the adjacent juxtaposed buckstay beam end element;

means connecting respective ends of said link means to said corner element and to the adjacent juxtaposed buckstay beam end elements, said connecting means connecting said link means and said elements through means defining a clearance in at least one of said elements; and means for adjusting the effective length of said link means.

11. The structure according to claim 10, wherein said link means comprise a first member pivotally connected to one of said elements, a second member pivotally connected to the other of said elements and a turnbuckle for adjusting the effective length thereof.

12. The structure according to claim 10, wherein said link means comprise a first member pivotally connected to one of said elements, a second member pivotally connected to the other of said elements, means of adjustable length connected said first and second members for adjusting the effective length of said link means, and means limiting the extent of adjustment of said first and second members towards each other.

13. The structure according to claim 12, wherein said means of adjustable length comprise threaded bolts extending through said first and second members and nuts threadedly engaging said bolts and adapted to vary the effective length thereof, and wherein said means limiting the extent of adjustment of said first and second members towards each other comprise a recess formed in one of said members and a projection formed on the other of said members and extending into said recess and normally spaced from the base of said recess to define the maximum adjustment of said members towards each other.

14. The structure according to claim 10, wherein said means defining a clearance in at least one of said elements comprise a slot formed in said corner element and through which said connecting means pass and wherein said adjustment means are provided for adjusting the position of said connecting means relatively to said slot.

15. The structure according to claim 10, wherein said means defining a clearance in at least one of said elements comprise a slot formed in said end element and through which said connecting means pass and wherein said adjustment means are provided for adjusting the position of said connecting means relatively to said slot.

16. The structure according to claim 14, wherein said adjustment means comprise a threaded stud mounted relative to said link means and adapted to abut against said connecting means to adjust the position of same in said slot when said stud is rotated.

17. The structure according to claim 15, wherein said adjustment means comprises a threaded stud mounted relative to said link means and adapted to abut against said connecting means to adjust the position of same in said slot when said stud is rotated.

18. The structure according to claim 10, wherein said link means has an end extending through one of said elements and is provided with clamping means having a narrow rocking surface bearing against said element and adjustment means are movable on said link means for controlling the position of said clamping means relative to said link means.

19. In a vapor generator or the like comprising:

a first pair of oppositely disposed vertical walls, and a second pair of oppositely disposed vertical walls extending between said first pair of walls and joined thereto to define a chamber for hot gases;

a buckstay beam disposed transversely adjacent each of said walls and having elements which extend beyond the ends of the adjacent wall, whereby end elements of adjacent buckstay beams are juxtaposed at each wall corner by adjacent walls of the generator;

means supporting said beams in spaced relationship to said walls and including means permitting differential transverse thermal expansion between said walls and beams; and corner assembly means connecting adjacent buckstay beam end elements, each assembly means comprising a corner element, means supporting said corner element relative to a wall corner, link means extending between said corner element and the adjacent juxtaposed beam end element; connecting means pivotally connecting respective ends of said link means to said corner element and to the adjacent and juxtaposed beam end elements;

means defining an opening in at least one of said elements for receiving said connecting means, said opening being of size relative to said connecting means to permit lateral movement of said connecting means;

and means for controlling the position of said connecting means in said opening.

20. An adjustable buckstay system according to claim 19, wherein said adjusting means comprise a stud connected to said beam and extending toward the associated generator wall and means threadedly engaging said stud to provide a clearance between the distal end of said stud and said wall, said last mentioned means being rotatable to adjust the magnitude of said clearance.

21. An adjustable buckstay system for controlling vibration in vapor generators and the like which include plurality of vertically disposed walls defining a chamber for hot gases, said buckstay system comprising:

a buckstay beam disposed transversely adjacent each of said walls at different elevations thereof and having end elements which extend beyond the ends of the adjacent walls, whereby the end elements of adjacent buckstay beams are juxtaposed at each wall corner defined by adjacent walls of the generator;

a tension tie disposed transversely adjacent each of said walls between each beam and the associated wall;

corner assembly means connecting adjacent buckstay beam end elements and adjacent tension tie ends, each assembly means comprising a corner element, means supporting said corner element relative to a wall corner, link means extending between said corner element and the adjacent juxtaposed beam end element; connecting means pivotally connecting respective ends of said link means to said corner element and to the adjacent juxtaposed beam end elements;

means defining an opening in at least one of said elements for receiving said connecting means, said opening being of size relative to said connecting means to permit lateral movement of said connecting means;

and means for controlling the position of said connecting means in said opening;

a vertical beam connecting adjacent transverse buckstay beams;

spacer assemblies having elements connecting said vertical beams and respective associated walls in spaced relationship and including means for permitting relative movement between said beams and respective associated generator walls due to differential thermal expansion between said walls and said beams;

said means for permitting relative movement between said beams and said generator walls including means defining a clearance of predetermined magnitude between said vertical beam and said wall; and adjustment means for adjusting the magnitude of said clearance.

* * * * *